US006792622B2

(12) United States Patent
Graves

(10) Patent No.: US 6,792,622 B2
(45) Date of Patent: Sep. 21, 2004

(54) PATIENT GARMENTS

(76) Inventor: Stephen K. Graves, 1030 SE. 7th Ave., Pompano Beach, FL (US) 33060

( * ) Notice: Subject to any disclaimer, the term of this patent is extended or adjusted under 35 U.S.C. 154(b) by 141 days.

(21) Appl. No.: 10/097,709

(22) Filed: Mar. 14, 2002

(65) Prior Publication Data

US 2004/0010837 A1 Jan. 22, 2004

(51) Int. Cl.[7] ..... A41B 1/00
(52) U.S. Cl. ..... 2/114; 2/69; 2/115; 2/912
(58) Field of Search ..... 2/114, 69, 115, 2/108, 96, 95, 85, 80, 83, 125, 126, 105, 106, 79, 912

(56) References Cited

U.S. PATENT DOCUMENTS

| | | | | |
|---|---|---|---|---|
| 211,426 A | * | 1/1879 | Rogers | 2/85 |
| 339,920 A | * | 4/1886 | Paulme | 2/85 |
| 1,010,679 A | * | 12/1911 | Padernacht | 2/85 |
| 2,736,900 A | | 10/1956 | Koren | |
| 3,102,270 A | * | 9/1963 | Izzo | 2/96 |
| 3,116,491 A | * | 1/1964 | Preridi et al. | 2/102 |
| 3,196,459 A | * | 7/1965 | De Grazia | 2/85 |
| 3,276,036 A | | 10/1966 | Cater | |
| 3,490,072 A | | 1/1970 | Keltner | |
| 4,258,440 A | | 3/1981 | McGowan | |
| 4,638,509 A | | 1/1987 | Charron | |
| 4,787,101 A | | 11/1988 | Feinberg | |
| 4,914,756 A | | 4/1990 | Grassick | |
| 4,964,173 A | | 10/1990 | Gordon et al. | |
| 5,062,159 A | | 11/1991 | Jakub | |
| 5,097,535 A | | 3/1992 | Dye et al. | |
| 5,157,789 A | | 10/1992 | Klass | |
| 5,564,123 A | | 10/1996 | Grassick | |
| 5,991,923 A | | 11/1999 | Maria | |
| 6,115,839 A | | 9/2000 | Covington et al. | |
| 6,119,270 A | | 9/2000 | Chou | |

* cited by examiner

*Primary Examiner*—Gloria M. Hale
(74) *Attorney, Agent, or Firm*—David P. Lhota, Esq.; Stearns Weaver Miller Weissler Alhadeff & Sitterson P.A.

(57) ABSTRACT

Hospital patient garments that resemble conventional clothing while offering the convenience of conventional hospital gowns comprising a central panel, a first sleeve panel and second sleeve panel connected to opposite side edges of the central panel, first side panel and second side panel connected to opposite side edges of the central panel below the first and second sleeve panels, third sleeve panel and fourth sleeve panel defined between the first and second sleeve panels and side panels, respectively, upper back panel, collar, head and neck opening defined by the central panel, plurality of buttonholes in the first and second sleeve panels and first and second side panels, and a plurality of buttons affixed to the sleeve panels, side panels and center panels.

20 Claims, 7 Drawing Sheets

10
13
27
21
20
22
15
23
12
25
26
28
19
17
35
36
11
37
14
24
34
33
32
18
16

27
28
17a
35
17
15
20
22
24
29
33
30
16a
16
32
26
25

PATIENT GARMENTS

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention generally to hospital patient clothing, and more particularly, to hospital patient clothing that may be placed on the patient while the patient is laying down and resembles conventional clothing.

2. Description of the Background Art

Hospital gowns for hospital patients are well known in the art. Conventional hospital gowns comprise a long shirt-like structure that ties in the back. Hospital gowns are typically placed on the patient while the patient is standing or sitting up. For certain patients, sitting or standing up can aggravate existing injuries or ailments and result in great discomfort to the patient. In addition, conventional clothing may be difficult to put on a patient because of the design of the clothing and in certain situations, the existence of hospital tubes and cords. Moreover, hospital gowns are unattractive, such that many patients are embarrassed by their appearance in the gown, especially when receiving guests. In fact, it is believed that a patient's mood and attitude can be adversely affected by wearing the same hospital gown every day and in some instances, result in a feeling of hopelessness. Conversely, a patient's mood and attitude could be improved by having a selection of stylized hospital gowns that resemble conventional clothing. However, the prior art fails to provide stylized hospital gowns that resemble conventional clothes. Consequently, there exists a need for hospital patient clothing that resembles conventional clothes, but is more easily and conveniently worn.

Several forms of clothing and gowns are known in the background art. However, none of these addresses or solves the foregoing. For instance, references known in the art disclose various hospital gowns and garments adapted for convenient use by patients and the physically impaired. For instance, U.S. Pat. Nos. 3,276,036, 3,490,072, 4,964,173, and 5,157,789 disclose shirts and gowns that have front and back panels that are effectively hinged along one side and are connectable along an opposite side. U.S. Pat. Nos. 2,736,900, 4,258,440, 4,787,101, 5,062,159 and 6,115,839 disclose a front flap and back flap that are joined along a top edge and are releasably joined along the sides. U.S. Pat. No. 6,119,270 discloses a garment that employs zippers and buttons for closing the sleeves and front panel. U.S. Pat. Nos. 4,914,756 and 4,638,509 disclose trousers that use clips and straps to connect the side edges of the pant legs.

U.S. Pat. No. 5,564,123 discloses an upper garment formed of one or more sheets or sections in which all openings are separable along at least one seam so that the garment may be laid out flat.

As the above noted art fails to provide hospital clothing that may be worn like a gown, may be placed on a patient with minimal movement of the patient, accommodates hospital tubes and cords and resembles conventional clothing, there exists a need for such clothing. The instant invention solves this problem by providing hospital garments having these characteristics.

BRIEF SUMMARY OF THE INVENTION

Based on the foregoing, it is a primary object of the instant invention to provide hospital patient garments that may be placed on and worn by a patient while laying down.

It is another object of the instant invention to provide hospital patient garments that resemble conventional clothes.

It is an additional object of the instant invention to provide hospital patient garments that may be draped over a patient and secured to the patient without moving the patient or in a manner that only requires minimal movement.

It is a further object of the instant invention to provide hospital patient garments that accommodate tubes and cords that are attached to the patient.

It is also an object of the instant invention to provide hospital patient garments that fit a plurality of different sized people.

It is still another object of the instant invention to provide hospital patient garments that are adjustable to the size of the patient.

It is yet another object of the instant invention to provide hospital patient garments that allow a patient to preserve dignity.

In light of the foregoing objects, the instant invention provides hospital patient garments, including shirts, dresses and pants that resemble conventional clothing while offering the convenience of conventional hospital gowns. The hospital patient garments comprise a central panel, a first sleeve panel and second sleeve panel connected to opposite side edges of the central panel, first side panel and second side panel connected to opposite side edges of the central panel below the first and second sleeve panels, third sleeve panel and fourth sleeve panel defined between the first and second sleeve panels and side panels, respectively, upper back panel, collar, head and neck opening defined by the central panel, plurality of buttonholes in the first and second sleeve panels and first and second side panels, and a plurality of buttons affixed to the sleeve panels, side panels and center panels. The center panel defines a central seam that resembles the front button-up portion of a conventional shirt, however, remains permanently closed to give the look of a conventional shirt while remaining permanently closed. The buttonholes and buttons are strategically placed or defined in the sleeve panels, side panels and, or central panel to facilitate the adjustment of the garment's width to accommodate various sized people and, or to secure the garment to a patient. The buttonholes and buttons on the first and second sleeve panels secure the sleeves around a patient's arms and have openings therebetween for receiving and passing hospital tubes and cords. The buttonholes and buttons on the side panels and center panel are used to adjust the width of the garment. The third and fourth sleeve panels join the first and second sleeve panels to the first and second side panels, respectively, so as to completely cover the torso and arms of the patient. The third and fourth sleeve panels may be completely or partially connected to the side panels or completely detached. The head and neck opening is designed to fit over an average person's head and may comprise stretchable material to accommodate larger heads. The upper back panel drapes over the patients' shoulders and partially down the back.

The hospital patient clothing may comprise a shirt, dress and, or pants. The shirt and dress versions of the hospital patient clothing are similar in design, albeit, different in length. In addition, the dress version of the instant invention may vary in its appearance, such as not having a central seam section that resembles a buttoned-up shirt. The pants of the instant invention comprise two leg sections that drape and lap over a patient's legs and waist region and may be adjusted in width and/or by folding the pant legs over and securing them with the available buttons and buttonholes or hook-and-loop.

The hospital patient clothing may be placed on a patient with little or no movement of the patient. The shirt and dress versions of the instant invention are draped over a patient's torso region and secured thereto by wrapping the first and second sleeve panels around the patient's arms and securing the same with the available buttonholes and buttons. The width of the shirt and/or dress garment is adjusted by folding in the first and second side panels and securing them in place by aligning and connecting the appropriate buttons and buttonholes. The garment may have a plurality of button columns to facilitate a plurality of selectable widths. Alternatively, at least one side panel may have the plurality of buttons along one edge on the exterior surface of the garment, i.e. opposite the interior surface where the button columns and buttonholes may be found, to allow the side panels to be wrapped completely around the patient's torso and secured so that the shirt covers the patient's back. In the preferred embodiment, the side panels' width are adjusted by selecting the appropriate button columns and leaving additional material for tucking under the patient's sides. Similarly, the pants version of the instant invention is worn by draping the pants over the patient's waist and legs. The width of the pant legs are adjusted by connecting the buttonholes with the appropriate buttons leaving excess material for tucking underneath the patient's legs. Alternatively, the pant legs may be secured around a patient's legs by joining the buttonholes and buttons. Likewise, the waist width of the pants version of the instant invention may be adjusted by folding the upper pant flanges inward and securing it in place with corresponding buttonholes and buttons.

In accordance with these and other objects, which will become apparent hereinafter, the instant invention will now be described with particular reference to the accompanying drawings.

BRIEF DESCRIPTION OF THE SEVERAL VIEWS OF THE DRAWINGS

FIG. 12(*b*) is a front elevational view of the pants version of the instant invention in accordance with the alternative embodiment of the pants garment illustrating the use of hook and loop.

DETAILED DESCRIPTION OF THE INVENTION

Figures 1, 2:
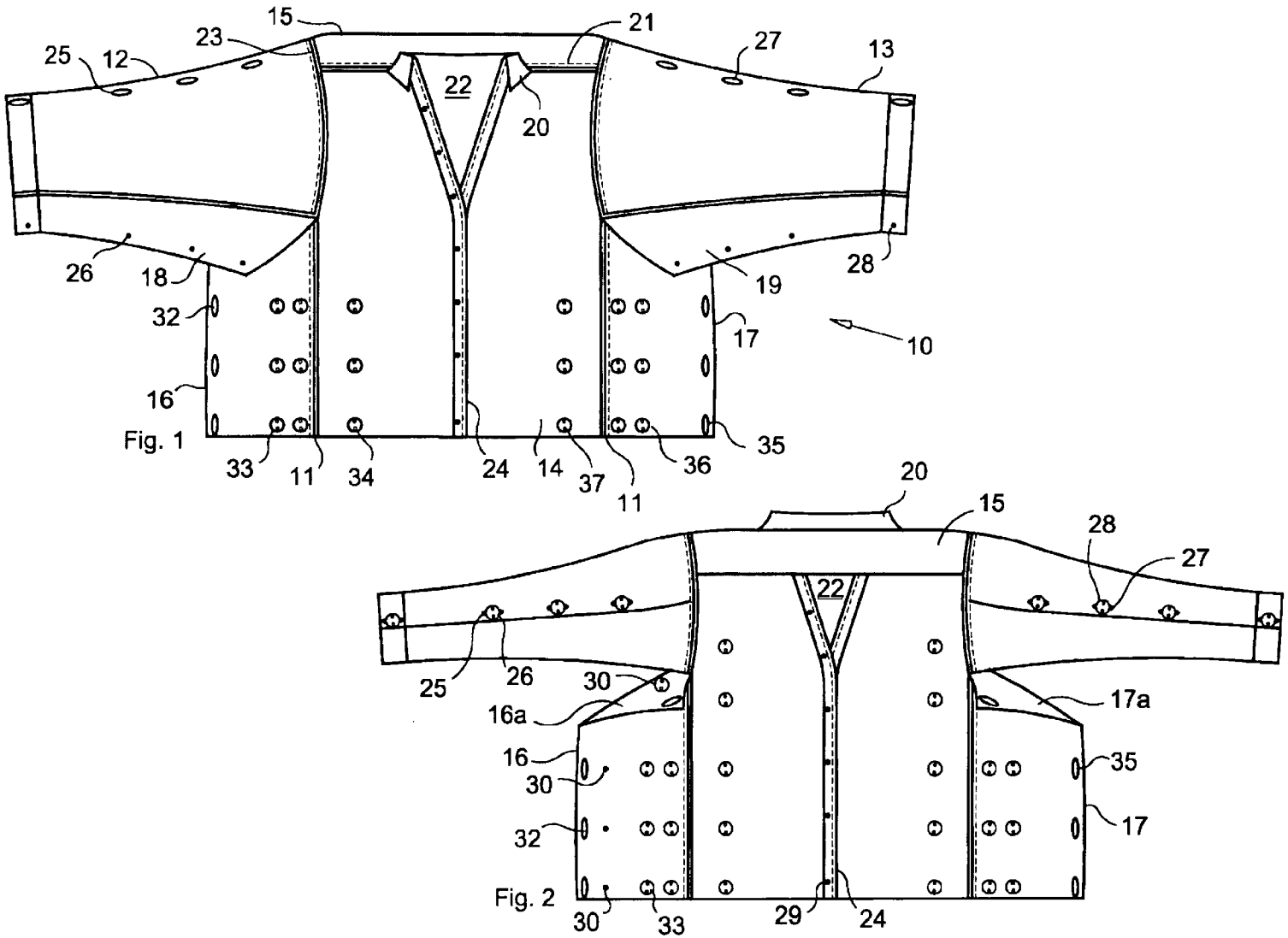
FIG. 1 is an interior elevational view of the interior surface of the patient shirt garment in accordance with the preferred embodiment of the instant invention.
FIG. 2 is an interior elevational view of the patient shirt garment in accordance with a first alternative embodiment illustrating the third and fourth sleeve panels partially disconnected from the first and second sleeve panels.
Figure 3:
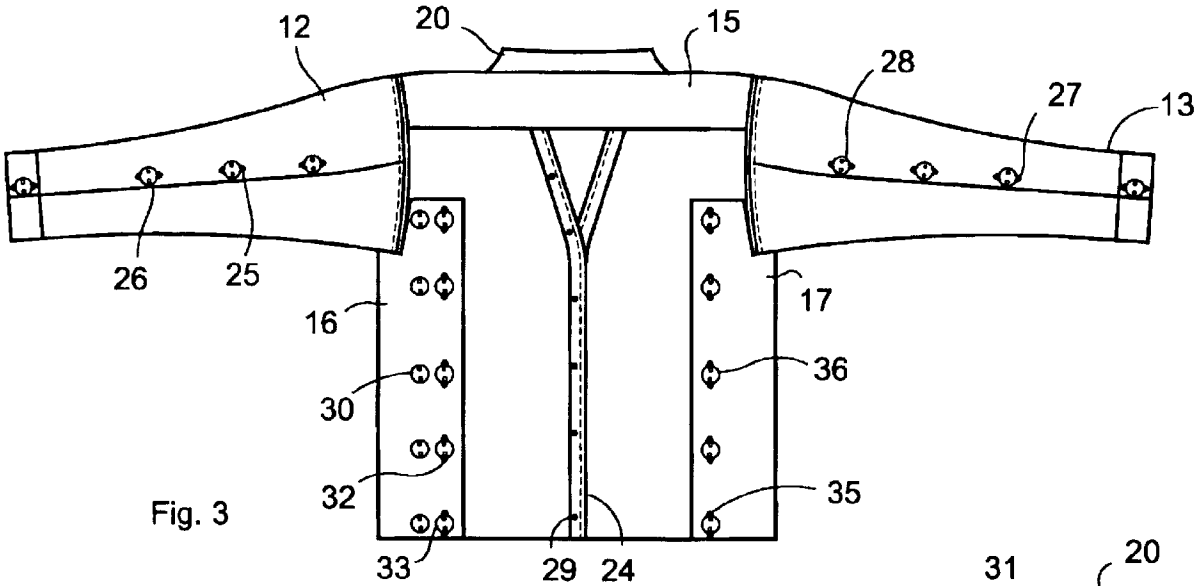
FIG. 3 is an interior elevational view of the patient shirt garment of the instant invention in accordance with the preferred embodiment illustrating the first and second sleeve panels in a closed position and the first and second side panels in a folded and secured position.

With reference to the drawings, FIGS. 1–12(*b*) depict the preferred and alternative embodiments of the instant invention, which is generally characterized as patient garments, and/or reference numeral 10. Although the instant invention 10 is primarily described with reference to the shirt version, the patient clothing 10 may also comprise a dress, which basically comprises a longer version of the shirt, as shown in FIGS. 1–8 and/or pants as shown in FIGS. 9–12(*b*). With reference to FIG. 1, the preferred embodiment of the patient garment 10 comprises a first sleeve panel 12, second sleeve panel 13, center panel 14, upper back panel 15, first side panel 16, second side panel 17, third sleeve panel 18, fourth sleeve panel 19, collar 20, head and neck opening 22, sleeve and center panel seams 23, first sleeve buttonholes 25, first sleeve buttons 26, second sleeve buttonholes 27, second sleeve buttons 28, first side panel buttonholes 32, first side panel buttons 33, center panel buttons 34, second side panel buttonholes 35, second side panel buttons 36, and center panel buttons 37. The shirt garment 10 may also comprise a center panel central seam 24 and central seam button stitching 29, as shown in FIGS. 1 and 2. The collar 20 and center panel 14 define a head and neck opening 22, for receiving a patient's head. The collar 20 and opening 22 may be defined by elastic or stretchy material so as to increase the size of the opening 22. The upper back panel 15, first and second sleeve panels 12–13, first and second side panels 16–17 are affixed to the center panel 14 by stitching, which defines seams 21, 23 and 11, respectively. The sleeve panels 12, 13, 18 and 19 wrap around and cover the arms and the center panel 14 and side panels 16, 17 cover the torso. The width of the garment 10 is adjusted by selecting the buttons 33, 34, 36 and/or 37 that correspond to the desired width and joining them with corresponding buttonholes. The side panels 16, 17 tuck under the patient.

Figure 4:
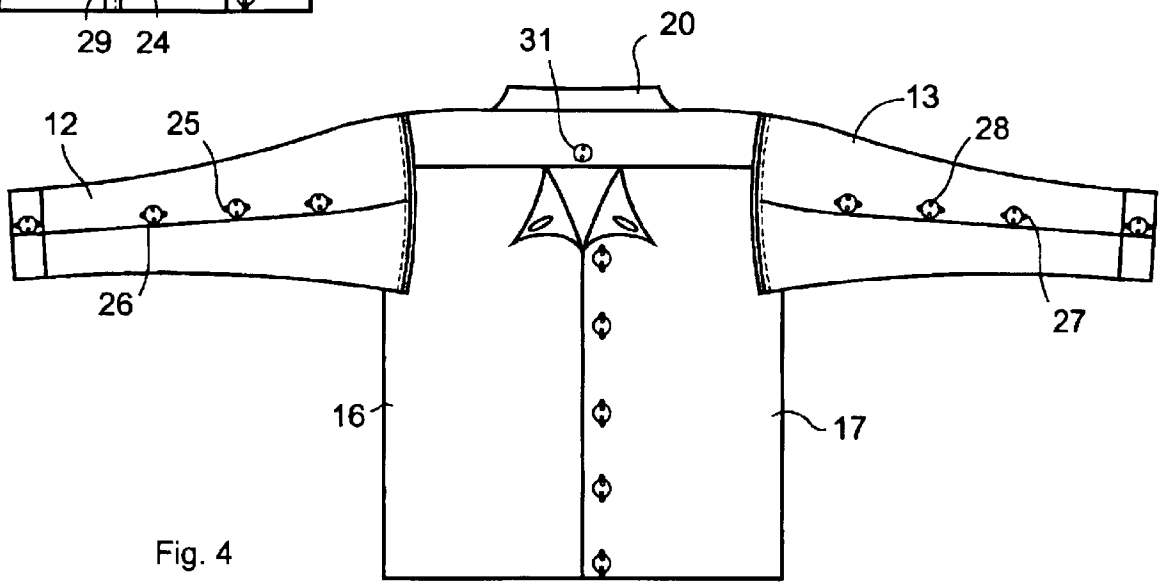
FIG. 4 is an exterior elevational view of the patient shirt garment of the instant invention illustrating the first and second side panels in a completely closed position in accordance with an alternative embodiment of the instant invention.
Figure 5:
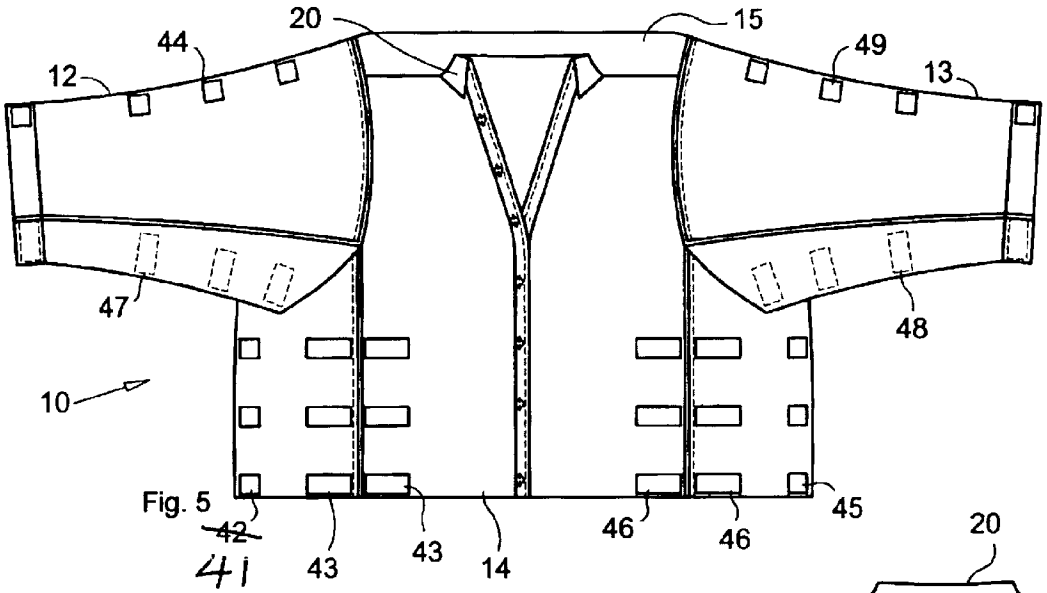
FIG. 5 is an interior elevational view of the patient shirt garment of the instant invention in accordance with a second alternative embodiment illustrating the use of hook and loop.
Figure 6:
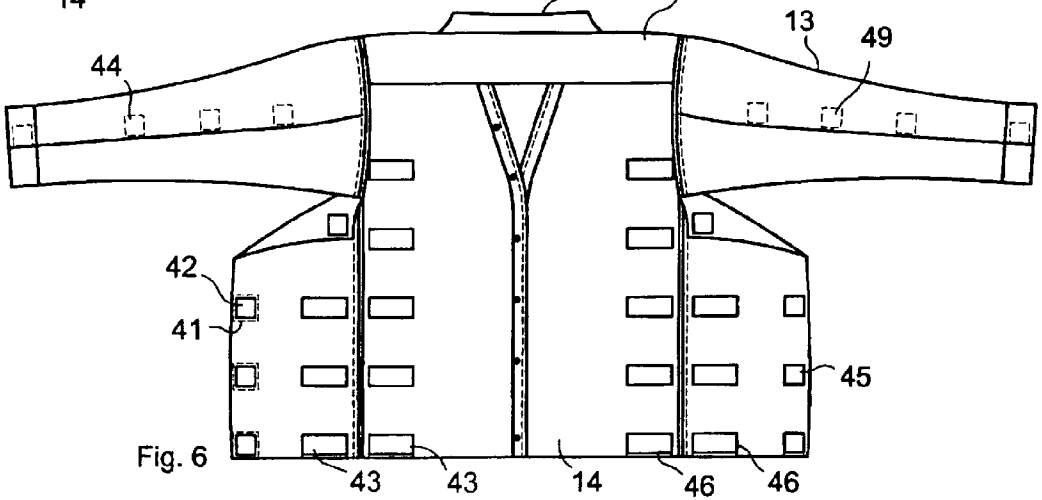
FIG. 6 is an interior elevational view of the patient shirt garment of the instant invention in accordance with a third alternative embodiment illustrating the use of hook and loop and the third and fourth panels partially disconnected from the first and second sleeve panels.
Figure 7:
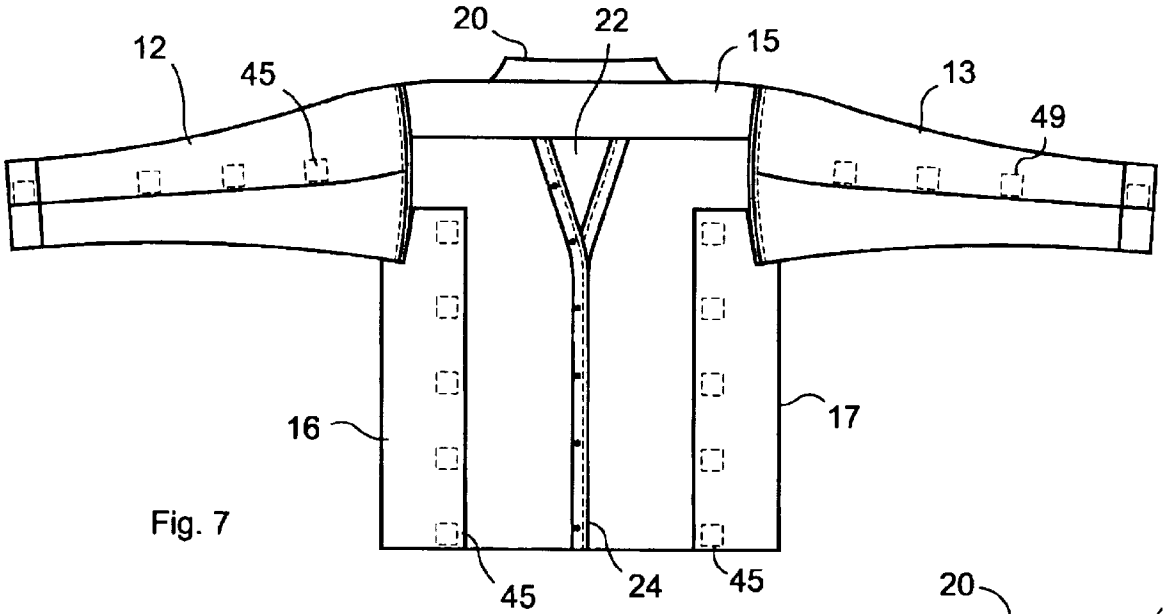
FIG. 7 is an interior elevational view of the patient shirt garment of the instant invention in accordance with the second alternative embodiment illustrating the sleeve panels in a closed position and the side panels in a folded and secured position.

The garment 10 sleeve panels 12, 13, 18 and 19, buttons 33, 34, 36 and/or 37, and buttonholes 25, 32 and/or 35 secure the clothing to a patient. Referring to FIG. 1, the buttons 26 and 28 on the third and fourth sleeve panels 18, 19 are accessed from the front exterior surface of the patient garment 10. The reference numerals 26 and 28 denote the buttons and stitching used to secure the buttons to the third and fourth panels 18,19. The garment 10 is secured to the patient by wrapping the first, second, third and fourth sleeve panels 12, 13, 18 and 19 around the patient's left and right arms and joining the buttons 26 and 28 with the buttonholes 25 and 27, respectively. The sleeve buttons 26 and 28 are secured to the exterior surface of the third and fourth sleeve panels 18, 19 for proper alignment of the panels and buttons 26, 28 with the buttonholes 25, 27, respectively. Openings are defined between the joined buttons 26, 28 and buttonholes 25, 27 for receiving and passing hospital cords and tubes. The third sleeve panel 18 and fourth sleeve panel 19 comprise additional cloth to wrap around the patient's arms. The third and fourth sleeve panels 18, 19 are connected to the lower edge of the first and second sleeve panels 12, 13, respectively, and the top edge of the side panels 16, 17. With reference to FIG. 2, in an alternative embodiment the third and fourth sleeve panels 18, 19 may be detached from the first and second side panels 16, 17 and/or partially attached to the first and second side panels 16, 17. With reference to FIGS. 1–4, the width of the patient's shirt and/or dress garment 10 is adjusted by folding the side panels 16 and 17 inward. A plurality of buttons 33, 34, 36, 37 are provided on the rear surface of the first side panel 16, center panel 14 and second side panel 17 for adjusting the width of the garment 10. The buttons 33, 34, 36 and 37 are arranged in columns and are selected based on the desired width. With reference to FIG. 4, the first side panel 16 and second side panel 17 may be folded all the way inward such that the outside edges of the side panels 16, 17 engage to provide complete coverage of a patient's back. Accordingly, either the first side panel 16 or second side panel 17 may have a plurality of buttons on the exterior surface for engagement with either the buttonholes 35 or 32 depending on which panel has the corresponding buttons 30.

Figure 8:
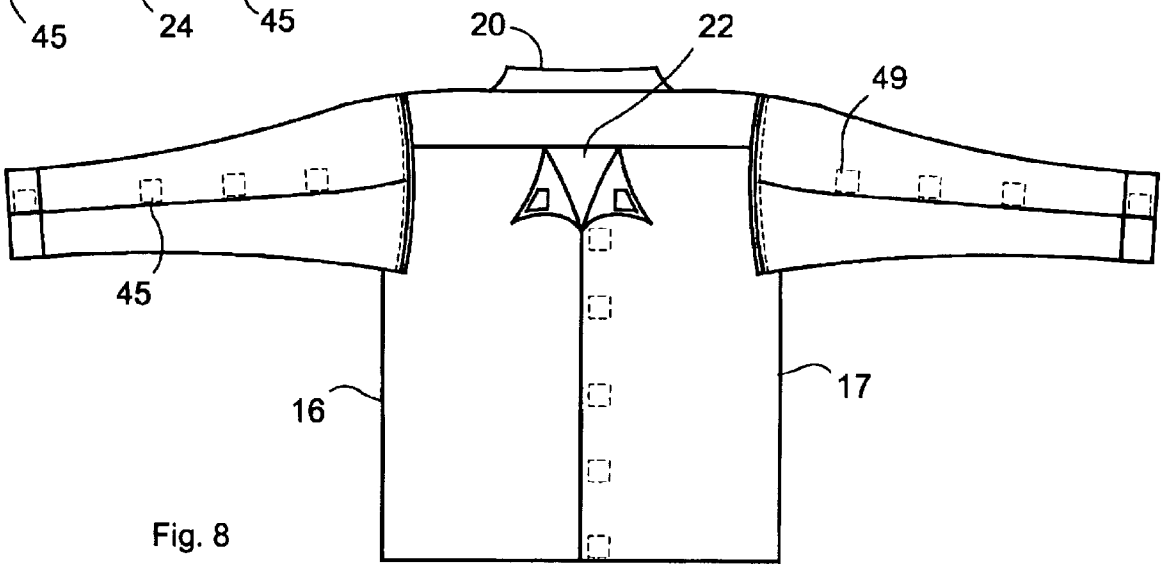
FIG. 8 is an exterior elevational view of the patient shirt garment of the instant invention in accordance with the second alternative embodiment illustrating the use of hook and loop to completely join the side panels.

With reference to FIGS. 5–8 in an alternate embodiment, the buttons and buttonholes may be replaced with hook and loop patches and/or strips 42–47. The buttonholes are replaced with a first set of hook and loop patches 42, 45 while the buttons are replaced with a set of corresponding hook and loop strips 43, 46. The hook and loop patches are placed in locations coinciding with the buttonholes and buttons. Instead of employing a plurality of button columns, one column of a plurality of elongated hook and loop strips 43,46 are disposed on the rear surface of the side panels 16 and 17 and/or the center panel 14 for attaching to hook and loop patches 42,45, respectively, on the interior surface of the side panels 16, 17. The first and second sleeve panels 12, 13 have hook and loop patches 44 and 49, and hook and loop strips 47 and 48, respectively. The first and second side panels 16 and 17 have hook and loop patches 42 and 45 and hook and loop strips 43 and 46, respectively. The center panel 14 may also include hook and loop strips 44 and 47. The strips preferably have sufficient length for accommodating a plurality of adjustments and widths. With reference to FIG. 8, at least one hook and loop patch 41 may be disposed on the front surface along the edge of either the first side panel 16 or the second side panel 17 to facilitate complete closure and joining of the side panel 16, 17.

Figure 10:
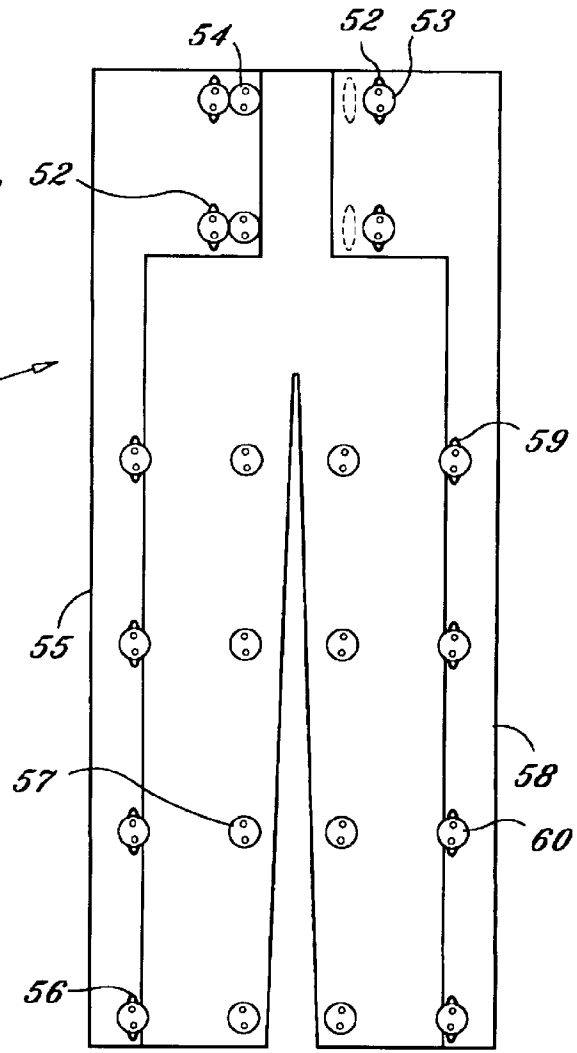
FIG. 10 is an interior elevational view of the patient pant garment of the instant invention in accordance with the preferred embodiment illustrating the pant legs in a partially folded position.
Figure 9:
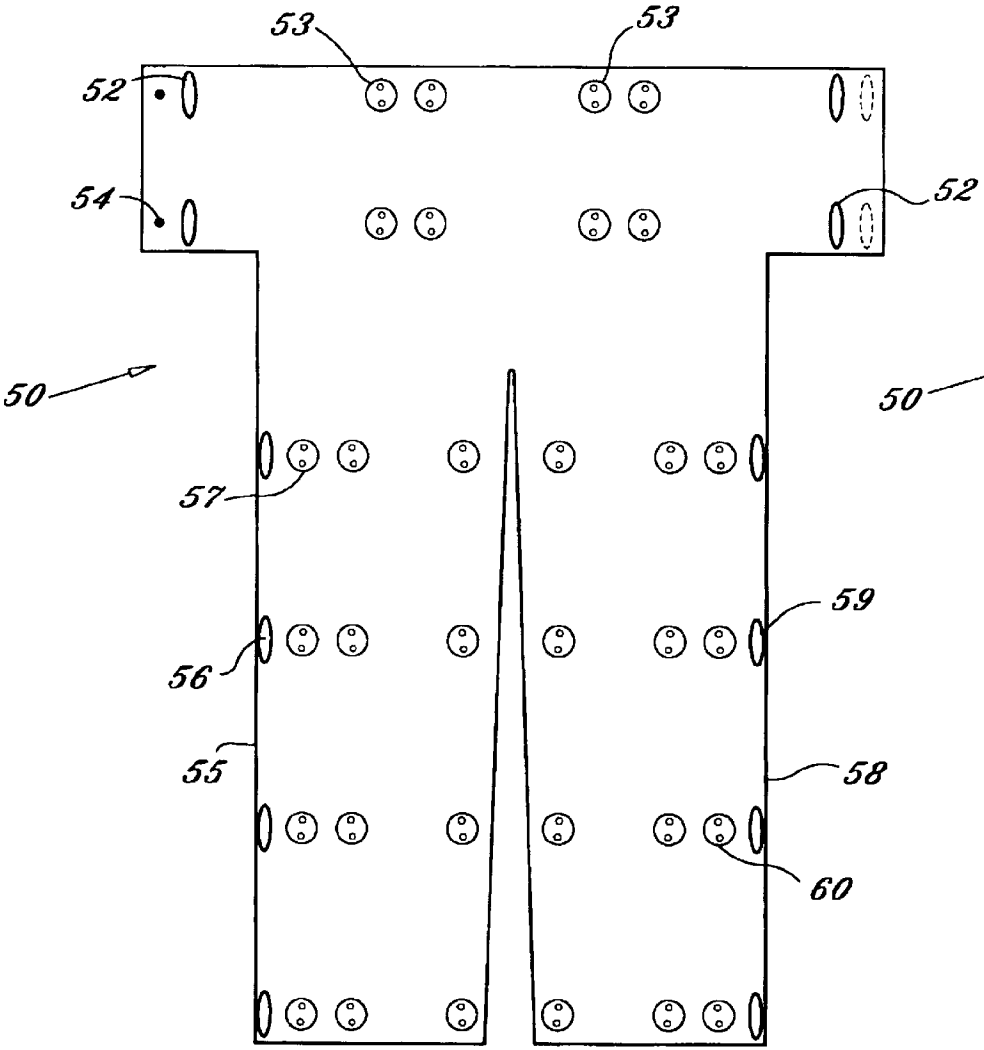
FIG. 9 is an interior elevational view of the patient pant garment of the instant invention illustrating the pants garment completely open.
Figure 11:
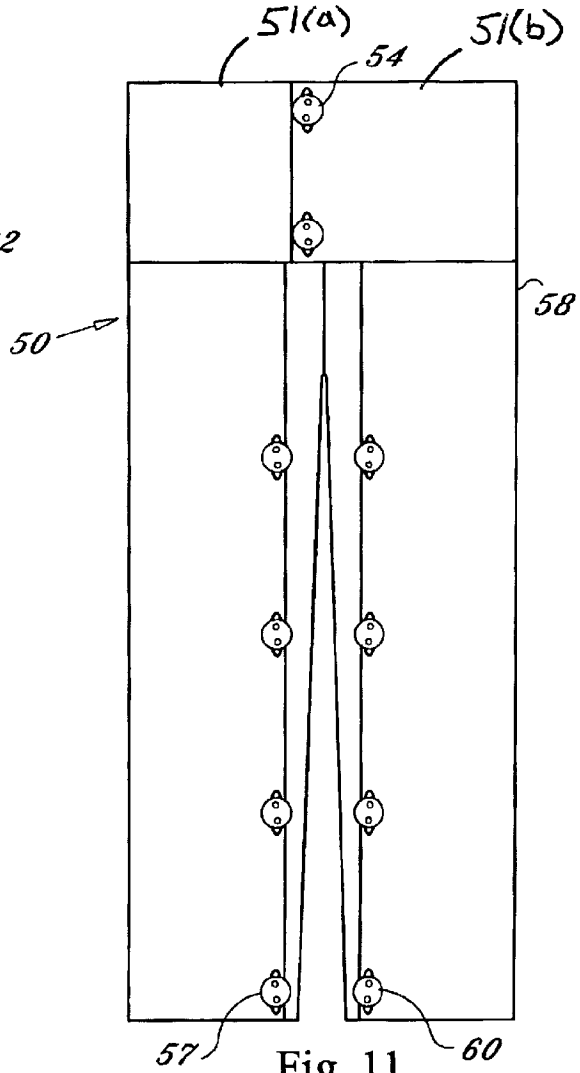
FIG. 11 is an exterior elevational view of the patient pants garment of the instant invention in accordance with the preferred embodiment illustrating the pant legs being completely closed.
Figure 12A:
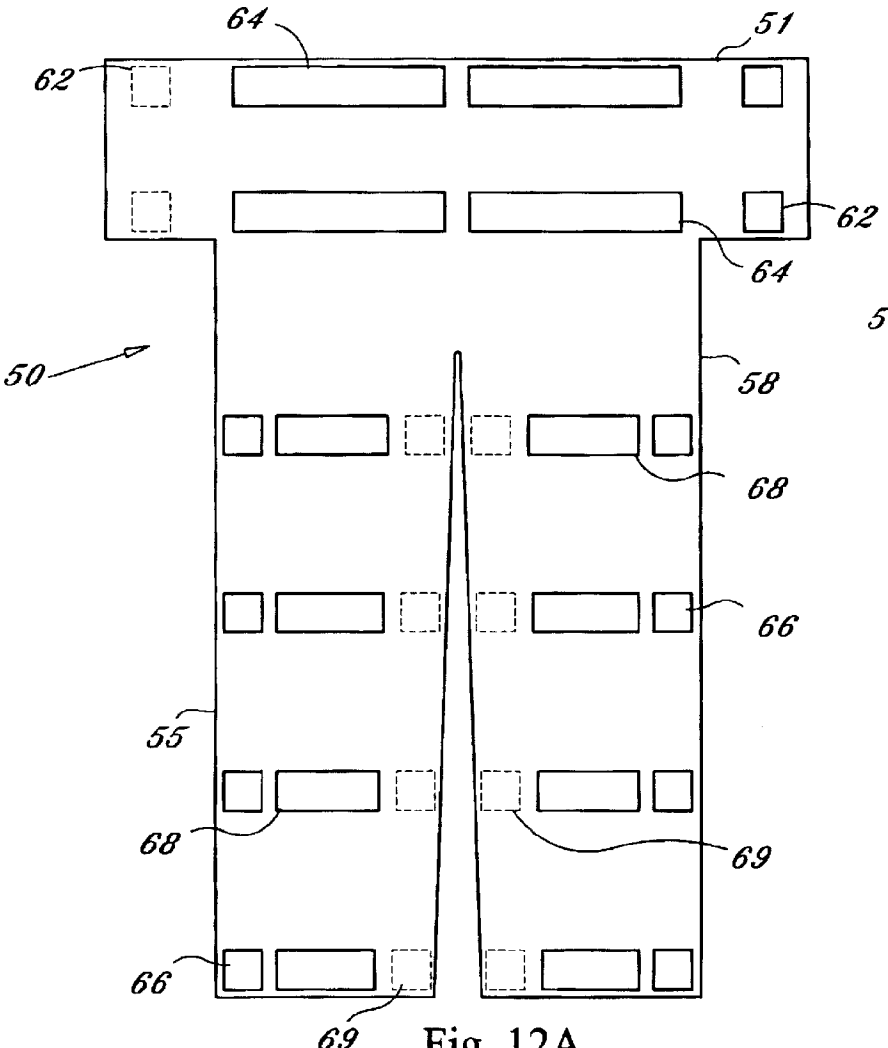
FIG. 12(*a*) is an interior elevational view of the patient pants garment of the instant invention in accordance with an alternative embodiment of the pants garment illustrating the use of hook and loop.
Figure 12B:
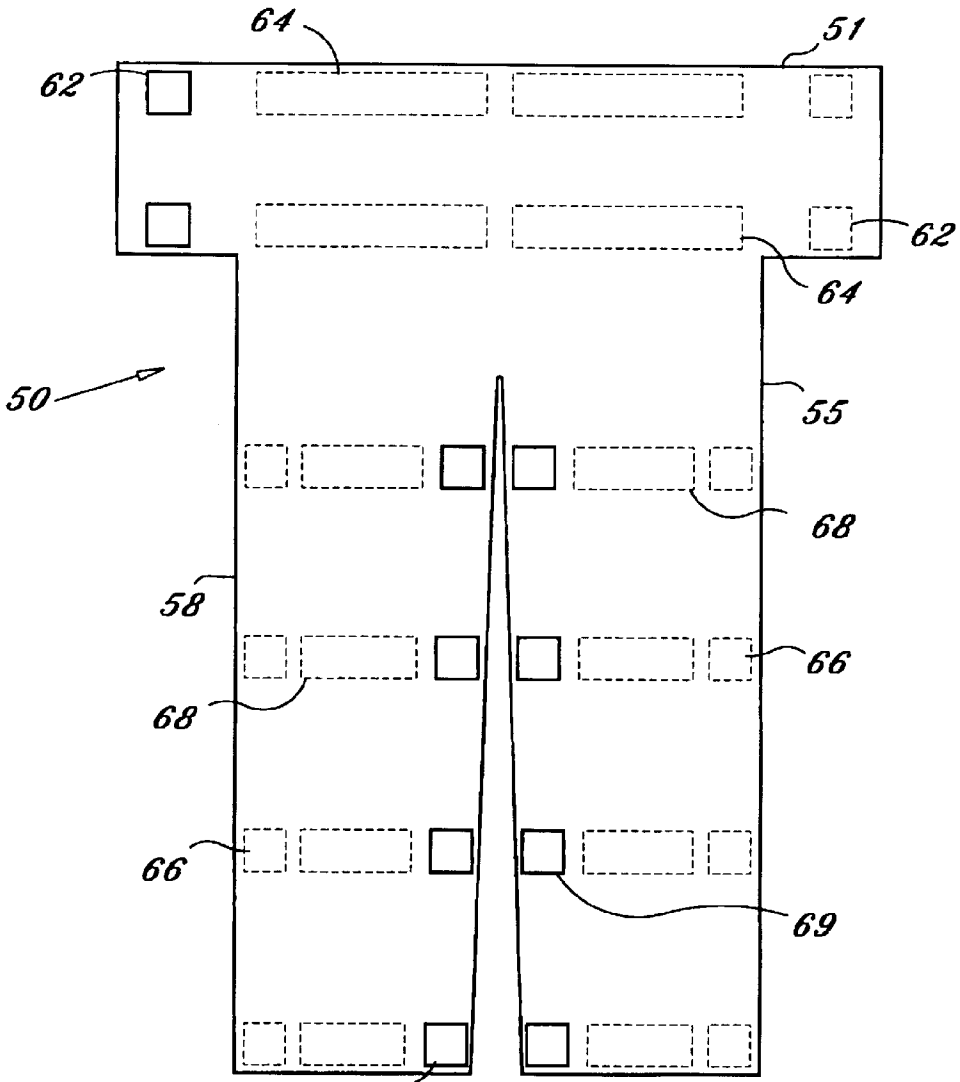

With reference to FIGS. 9–12(*b*), the patient garment 10 of the instant invention may also comprise pants 50. The pants version 50 of the instant invention 10 comprises a waist section 51, first leg 55, second leg 58, a rear surface having a plurality of buttonholes 56, 59 along each side edge and a plurality of buttons 57, 60 preferably arranged in columns on each pant leg 55, 58 between the top and bottom edges. The width of the pant legs 55, 58 are adjusted by folding the side edges 62, 64 inward and joining the buttonholes 56, 59 with the corresponding buttons 57, 60 corresponding to the desired width, as shown in FIG. 10. With reference to FIG. 11, the pants 50 may be completely closed. This is done by providing at least one button 54 on the front surface of one waist flange 51(*a*), at least one buttonhole 52 on the opposite waist flange 51(*b*) and a plurality of buttons 57, 60 along the inside edges in a position that corresponds to the buttonholes along the outside edges, as shown in FIG. 11. In an alternative embodiment, the buttonholes 52, 56 and 59 may be replaced with hook and loop patches 62, 66 and 69 and strips 64, 68, as shown in FIGS. 12(*a*) and 12(*b*). With reference to FIG. 12(*a*), the alternative pant design comprises a plurality of hook and loop patches in the waist section 51(*a*) and along the pant leg edges, and a plurality of hook and loop strips 64, 68 between the top edge and bottom edge in the waist section 51 and pant legs 55, 58. With reference to FIG. 12(*b*), the front surface of the pants are shown and illustrate the placement of hook and loop patches 62, 66 and 69 and strips 64 and 68 for effecting a complete closure of the pants around the patient's legs and waist.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. A garment for hospital patients and infirm patients that simulates the look of conventional clothing and may be conveniently placed on patients, said garment comprising:

a first sleeve panel having a top edge and a bottom edge;

a second sleeve panel having a top edge and a bottom edge;

a center panel having a first side edge and a second side edge, said first sleeve panel projecting outward from said first side edge, said second sleeve panel projecting outward from said second side edge;

means, extending from said center panel, for covering and wrapping around a patient's torso sides; said center panel and covering means defining a first width; and means for defining an adjustable second width that is smaller than said first width, said second width being defined by said center panel and said covering means; and means for joining said first sleeve panel top edge and bottom edge; and means for joining said second sleeve panel top edge and bottom edge.

2. A garment as recited in claim 1, wherein said covering means comprises:

a first side panel extending from said center panel first side edge below said first sleeve panel; and a second side panel extending from said center panel second side edge below said second sleeve panel.

3. A garment as recited in claim 2, wherein said means for defining an adjustable second width comprises:

a plurality of fasteners at least partially disposed on said side panels, and a plurality of corresponding fasteners at least partially disposed on said side panels, said fasteners and corresponding fasteners defining said second width when joined.

4. A garment as recited in claim 1, wherein said means for defining an adjustable second width comprises:

a plurality of fasteners at least partially disposed on said covering means, and a plurality of corresponding fasteners at least partially disposed on said covering means, said fasteners and corresponding fasteners defining said second width when joined.

5. A garment as recited in claim 1, wherein said means for joining said first sleeve panel top edge and bottom edge comprises:

a plurality of fasteners disposed proximal said top edge; and a plurality of corresponding fasteners disposed proximal said bottom edge.

6. A garment as recited in claim 5, wherein said means for joining said second sleeve panel top edge and bottom edge comprises:

a plurality of fasteners disposed proximal said top edge; and a plurality of corresponding fasteners disposed proximal said bottom edge.

7. A garment as recited in claim 1, wherein said means for defining an adjustable second width comprises:

a plurality of buttons at least partially disposed on said covering and wrapping means; and a plurality of corresponding buttonholes at least partially defined by said covering and wrapping means.

8. A garment as recited in claim 1, wherein said means for defining an adjustable second width comprises:

a plurality of snaps at least partially disposed on said covering and wrapping means; and a plurality of corresponding snap receptors at least partially defined by said covering and wrapping means.

9. A garment as recited in claim 1, wherein said means for defining an adjustable second width comprises:

at least one hook-and-loop patch at least partially disposed on said covering and wrapping means; and at least one corresponding hook-and-loop patch at least partially defined by said covering and wrapping means.

10. A garment as recited in claim 1, wherein said means for joining comprises:

a plurality of button fasteners at least partially disposed proximal said top edge; and a plurality of corresponding button fasteners disposed proximal said bottom edge.

11. A garment as recited in claim 1, wherein said means for joining comprises:

a plurality of snap fasteners at least partially disposed proximal said top edge; and a plurality of corresponding snap fasteners disposed proximal said bottom edge.

12. A garment as recited in claim 1, wherein said means for joining comprises:

at least one hook-and-loop patch disposed proximal said top edge; and at least one corresponding hook-and-loop patch disposed proximal said bottom edge.

13. A garment as recited in claim 1, wherein said center panel comprises:

at least one seam resembling a shirtfront joined by buttons.

14. A garment as recited in claim 1, wherein said means for covering and wrapping is at least partially joined to said first sleeve panel bottom edge and said second sleeve bottom edge.

15. A garment as recited in claim 1, wherein said means for defining an adjustable second width comprises:

a plurality of fasteners at least partially disposed on said center panel; and a plurality of corresponding fasteners at least partially disposed on said center panel, said fasteners and corresponding fasteners defining said second width when joined.

16. A garment as recited in claim 1, further comprising:

a top panel joined to a top edge of said center panel.

17. A garment as recited in claim 1, further comprising:

an opening at least partially defined by said center panel for receiving and passing a patient's head.

18. A garment for hospital patients and infirm patients that simulates the look of conventional clothing and may be conveniently placed on patients, said garment comprising:

a first sleeve panel having an outside edge, an inside edge and an adjustable width;

a second sleeve panel having an outside edge, an inside edge and an adjustable width;

a center panel, said first sleeve panel and said second sleeve panel projecting out from said center panel;

means for adjustably wrapping an extension of said center panel around a patient's torso side; and means for adjusting said first sleeve panel width and said second sleeve width.

19. A garment as recited in claim 18, wherein said means for adjusting said width comprises:

a plurality of fasteners at least partially disposed on said sleeve panels, and a plurality of corresponding fasteners at least partially disposed on said sleeve panels, said fasteners and corresponding fasteners defining said adjustable width when joined.

20. A garment as recited in claim 18, wherein said means for adjustably wrapping an extension of said center panel comprises:

a first side panel extending from a first edge of said center panel having at least one first fastener; and a second side panel extending from a second edge of said center panel having at least one corresponding fastener that releasably fastens to said first fastener.

* * * * *